United States Patent [19]

Weckman

[11] 4,387,816

[45] Jun. 14, 1983

[54] COLLAPSE RESISTANT CONTAINER

[75] Inventor: Richard L. Weckman, Perrysburg, Ohio

[73] Assignee: Owens-Illinois, Inc., Toledo, Ohio

[21] Appl. No.: 340,567

[22] Filed: Jan. 18, 1982

[51] Int. Cl.[3] ..... B65D 1/02

[52] U.S. Cl. ..... 215/1 C

[58] Field of Search ..... 215/1 C, 365

[56] References Cited

U.S. PATENT DOCUMENTS 3,536,223 10/1970 Muhlhoff ..... 215/1 C

*Primary Examiner*—Donald F. Norton

*Attorney, Agent, or Firm*—Thomas L. Farquer; M. E. Click; D. H. Wilson, Jr.

[57] ABSTRACT

A freestanding unitary container fabricated from an organic thermoplastic material is disclosed which includes a neck portion terminating in a main body portion having a generally flat bottom portion. The main body portion includes opposed centrally located collapsible label panel areas having upstanding rim portions adjacent the margin of the centrally located label panel areas. A flexible hinge portion is disposed between the upstanding rim portions and the label panel portions and provides an area of flexion between the label panel areas and the rim portions. As a partial vacuum is formed in the interior of the container, the label panel areas are drawn inwardly. The flexible hinge portions flex to accommodate the change in the label panel areas and isolate the rim portions and adjoining container sidewall portions form structural distortion.

10 Claims, 9 Drawing Figures

COLLAPSE RESISTANT CONTAINER

DESCRIPTION

TECHNICAL FIELD

The present invention relates to freestanding unitary containers for containing volatile fluids, such as, charcoal lighter fluid, automotive engine treatments, clothing prewash formulations and similar fluids containing volatile organic components.

It is established practice to form organic thermoplastic containers by injection molding, injection-blow molding or extrusion-blow molding techniques. In injection molding the entire container is injection formed by forcing molten plastic into a mold conforming to the container shape and subsequently cooling the plastic. Containers may also be formed by injection molding a preform and subsequently blow molding the preform into the final container shape by injection-blow molding. In extrusion-blow molding a hollow pipe type preform is extruded in the molten state and blown between mold portions to form the final container shape. Containers formed by injection-blow molding or extrusion-blow molding may be processed to produce containers which show high degrees of molecular orientation or no significant molecular orientation. Generally molecularly oriented containers demonstrate improved strength and barrier properties compared to unoriented containers. Usually, containers used for high volatility, high solvent content materials are fabricated from thermoplastic resins which exhibit excellent strength and barrier properties. High barrier resins are well known in container forming applications.

However, even molecularly oriented containers fabricated from high barrier materials have limitations. Two problems are typically experienced with certain fluids, such as those described above, which contain volatile organic components are placed in containers. First, as volatile organic components of the content of the container gradually escape through the walls of the container by evaporation, a partial vacuum is formed on the inside of the container. Typically, the partial evacuation of the container causes the container to deform over time. Usually the deformation is most noticeable from an aesthetic point of view in the label panel area of the container. Such deformation is a commercially undesirable effect inasmuch as such deformation of the label panel area distorts or detaches the product identifying label.

Also, as the label panel area is drawing inwardly of the container, the plastic in the adjacent areas is stressed as the inwardly moving label area plastic attempts to displace the adjacent plastic. Where rigid plastic is placed under such stress it will stress craze and later stress crack. Either stress crazing or stress cracking effect the structural integrity of the package. In the extreme case, a complete label panel inward collapse occurs and causes a gross distortion of the adjacent sidewall of the container. Such gross distortion causes severe stress crazing or cracking and detrimentally effects the toploading stability of the container.

Similar effects are had when headspace gases are absorbed into the container content, thereby also effecting a partial evacuation of the interior of the container. In such cases, oxygen is absorbed by the package contents from the headspace causing partial evacuation of the interior.

The present invention embodies a controlled collapse label panel contruction which militates against such label panel deformation and the concomitant sidewall stresses, upon partial evacuation of the container interior.

BACKGROUND ART

In attempts to overcome the deformation problem in containers holding volatile organic substances or gas absorbing contents numerous approaches have been attempted.

One such approach has been to form containers of substantially thicker cross section than previously used to forestall deformation or buckling of the sidewall and adjacent areas upon partial evacuation. This approach necessitates the use of substantially more resin than a lighter weight container. Accordingly, the heavier containers are more costly to produce based upon resin cost per container.

Other attempts have been made to forestall transfer of the volatile organic substances across the container wall by using biaxially oriented containers of high barrier resins, such as, polyvinyl chloride, acrylonitrile and the like. The highly oriented containers of high barrier materials have also shown a tendency to buckle or to collapse in the label panel area as evaporation or headspace degasing occurs, with the associated stress crazing or cracking of the adjacent area to the label panel or the sidewall.

Yet another method to forestall label area collapse involves the use of structural reinforcement ribs about the circumference of the container. Such rib reinforced containers are generally limited to the circular cross section. The cross sectional limitation causes severe design choice limitations.

One design, shown in U.S. Design Pat. No. 259,181, shows a container having a novel ornamental design including a raised portion at the top and bottom of the label panel area.

DISCLOSURE OF THE INVENTION

The present invention comprises a freestanding unitary container formed of an organic thermoplastic material. The container includes an upstanding neck portion terminating in a finish defining an opening into the container. A pair of spaced apart sidewall panels connect to and downwardly depend from the neck portion and terminate in a generally flat bottom portion of the container. A pair of spaced apart label panel areas connect to the neck portion, sidewall portion and bottom portion and thereby define an enclosed volumn for the container. Each of said label panel areas includes a centrally located collapsible label area, a peripherally located upstanding rim portion and a flexible hinge portion connecting the rim portion to the label area. The flexible hinge portion flexes to accommodate the change in the label panel area and to isolate the rim portion and the associated container sidewall portions from structural distortion due to movement in the label panel areas.

Accordingly, it is an object and advantage of the present invention to provide a container for holding volatile or gas absorbing fluids without significant adverse container distortion.

It is another object and advantage of the present invention to provide a unitary thermoplastic container which exhibits controlled label panel collapse as a partial vacuum is formed on the interior of the closed container.

BRIEF DESCRIPTION OF THE DRAWINGS

The above and other objects and advantages of the present invention will become readily apparent to one skilled in the art from reading the following detailed description of the embodiments of the present invention, when considered in light of the associating drawings, in which.

DESCRIPTION OF THE INVENTION

Figure 2:
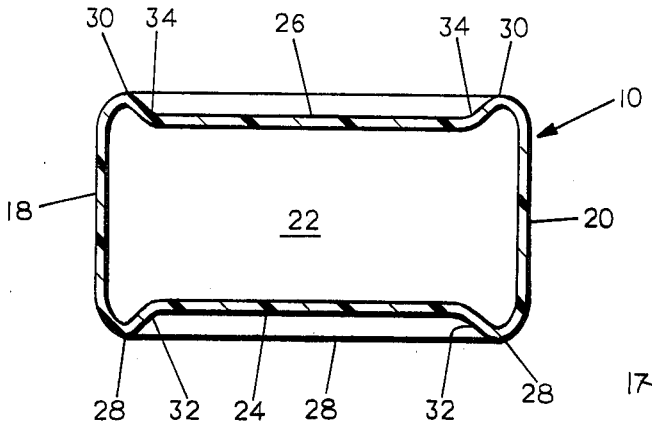
FIG. 2 is a cross sectional view along the lines 2—2.

Referring to the drawings, the present invention in its preferred embodiments comprises a freestanding unitary organic thermoplastic container for holding fluids, which contain volatile organic components or absorb headspace gases. The label bearing portions of the container are collapsible in a controlled fashion to militate against the collapse or stress degradation of other portions of the container.

Figure 1:
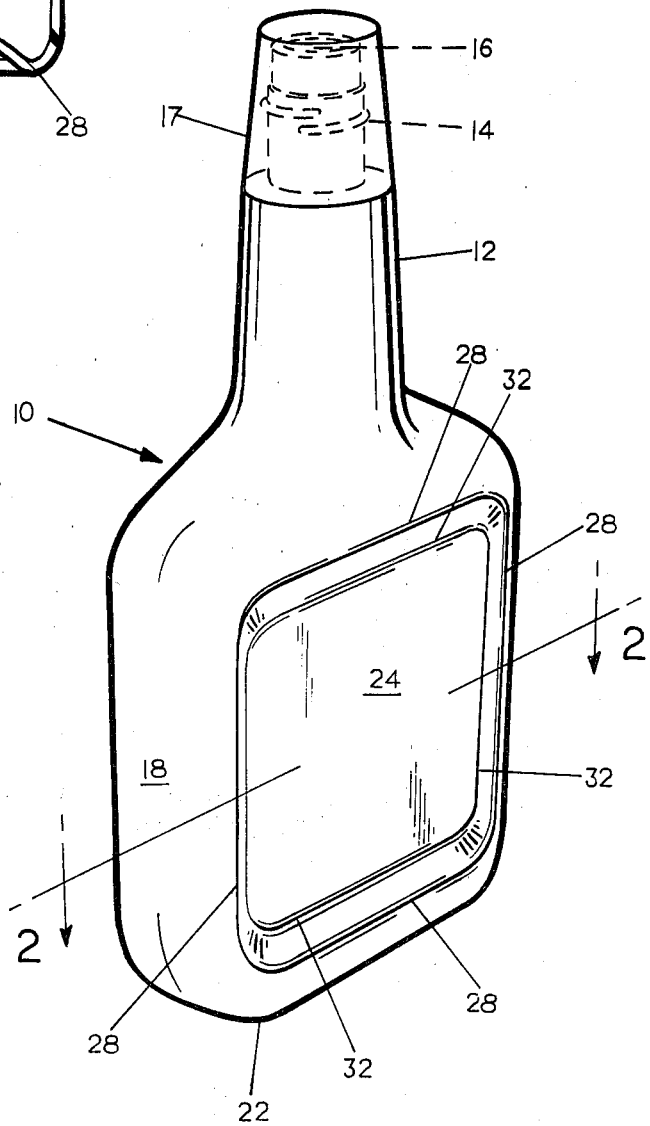
FIG. 1 is an elevational perspective view of the container according to the present invention.

Referring to FIGS. 1 and 2, a freestanding unitary container 10 is fabricated from a thermoplastic organic material. Typical of such thermoplastic organic materials are polyethylene, polypropylene, polyvinyl chloride, polyacrylonitrile and similar polymers. One acceptable method of container fabrication is by injection molding a parison or preform of the selected organic polymer and blow molding the resultant preform into a container shape. Also acceptable is the fabrication of the container by extrusion-blow molding wherein a tube or pipe of polymeric material is extruded in the molten state and clamped between blow mold sections with subsequent inflation into the container shape. Also injection molding may be used to form the container when desirable.

The container 10 includes a neck portion 12 having an upper finish portion 14 and an opening 16 communicating the exterior of the container to the hollow interior thereof. A suitable closure 17 is attached to the finish 14 to seal the container 10.

The neck portion 12 bifurcates at its lower most portion into a pair of sidewalls 18 and 20. The sidewalls 18 and 20 merge at their lowermost portion to form a generally flat bottom panel 22.

A pair of centrally located label areas 24 and 26 are each joined to an upstanding rim portion 28 and 30, respectively, by hinge portions 32 and 34, respectively. The hinge portions 32 and 34 extended completely about the margin of the label panels 24 and 26 and blend into the upstanding rim portions 28 and 30 to form a flexible bridge between the respective label panels 24 and 26 and rim portions 28 and 30.

In the embodiment shown at FIGS. 1 and 2, one rim portion, such as rim portion 28, is employed on each major face of the container. In the embodiment of FIGS. 1 and 2 the label areas 24 and 26 are indented into the container interior by a slight distance to develop the upstanding rim portions 28 and 30. The curved hinge portions 32 and 34 serve as shock absorbers between the rim portions 28 and 30 and sidewall portions 18 and 20 and the label panels 24 and 26. When a partial evacuation of the interior of the container occurs the tendency is for the generally flat label panel areas to bow inwardly of the container. In conventional containers, when the label areas do collapse inwardly they pull upon the plastic in the immediately peripherally adjacent areas to the label panels and cause high stresses to be concentrated in those areas. The concentration of such stresses in the areas adjacent the label area causes stress crazing or in extreme cases stress cracking of the areas. One effect of extreme label area bowing inwardly is that labels may detach. Further, the stresses concentrated around the peripheral area to the label area degrades the structural integrity and accordingly the top loading strength and other physical parameters of the container. Such degradation of physical properties of the container is particularly critical when the container holds material such as charcoal lighter fluid and clothing prewash formulations. Such formulation chemically attack the plastic of the container and when cooperating affects are had with the stress crack or crazed areas around the label areas, cause substantial weakening and collapsing of the container structure.

In the present invention, as the slow process of partial evacuation of the container occurs the collapsible label areas 24 and 26 are drawn inwardly of the container. The flexible hinge portions 32 and 34 are disposed between the label areas 24 and 26 which are collapsing inwardly and the adjoining upstanding rim portions 28 and 30 which are connected to the sidewall panels 18 and 20, the neck portion 12 and bottom portion 22. The hinge portions 32 and 34 act as shock absorbers to allow the inward flexion of the label panels 24 and 26 to dissipate in the hinge portions 32 and 34 and not adversely effect the rims 28 and 30, the sidewall panel 18 and 20, the neck 12 or the bottom panel 22.

The embodiment of the invention shown in FIGS. 1 and 2 illustrate the use of two lateral, one upper and one lower hinge section to isolate the remainder of the container 10 from stress due to controlled label panel collapse.

Figure 4:
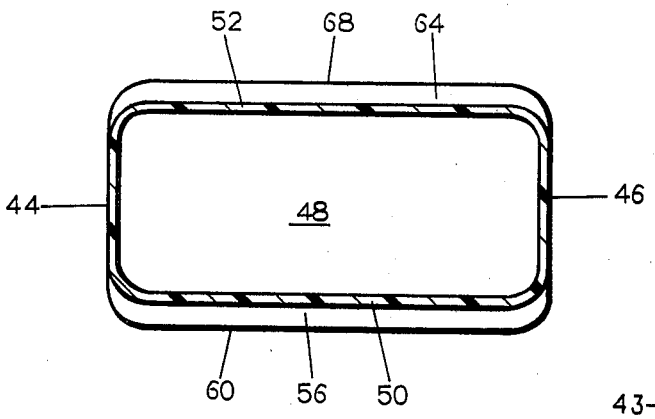
FIG. 4 is a cross sectional view along the lines 4—4.
Figure 3:
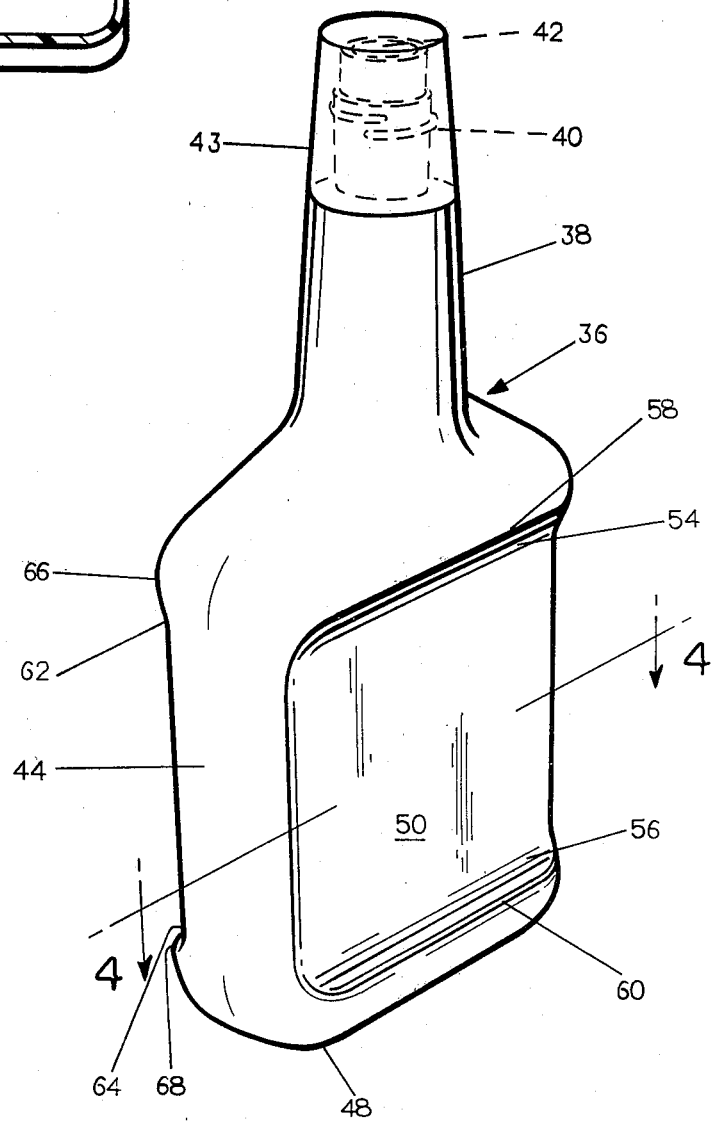
FIG. 3 is an elevational perspective view of another embodiment of a container according to the present invention.
Figure 5:
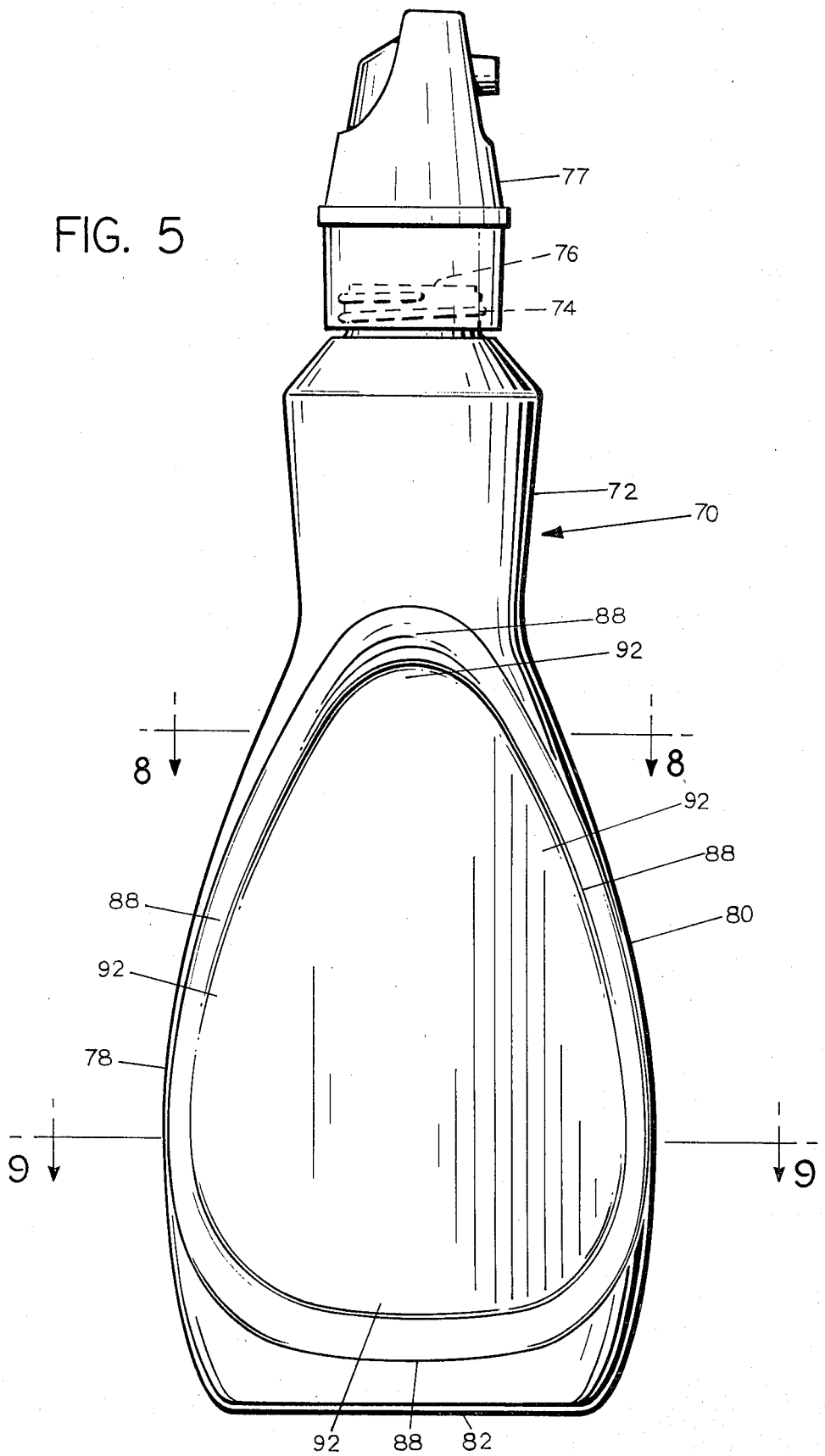
FIG. 5 is a front elevational view of another embodiment of the container of the present invention.

Another embodiment of the invention is illustrated in FIGS. 3 and 4. FIG. 3 is an elevational perspective view of a double hinge embodiment of the present invention. FIG. 4 is a cross-sectional view along the lines 4—4 of the double hinged embodiment of the present invention.

The container 36 illustrated in FIGS. 3 and 4 includes a neck portion 38 having a finish portion 40 terminating at its upper end in an opening 42 into the interior hollow space of the container. A suitable closure 43 is attached to the finish 40 to seal the container 36. The neck 38 bifurcates into a pair of sidewalls 44 and 46 which in turn terminate at their lowermost portions in a bottom panel 48. A pair of generally flat label panels 50 and 52, respectively, occupy the major faces of the container. A pair of hinge portions 54 and 56 blend the label panel 50 into engagement with a pair of upstanding rim portions 58 and 60. Similarly, a pair of hinge portions 62 and 64 blend the label panel 52 into a pair of upstanding rim portions 66 and 68. Similar to the embodiment shown in FIGS. 1 and 2, the embodiment of FIGS. 3 and 4 provides a shock absorbing means, namely the hinges 54 and 56 between the neck 38, rims 58 and 60 and the bottom panel 48, respectively. Similarly, the hinge portions 62 and 64 serve to isolate the neck 38, rims 66 and 68 together with the bottom panel 48 from the stresses induced by the label panel 52 collapsing inwardly under partial evacuation of the container.

Another embodiment of the present invention is shown in FIGS. 5 through 9 wherein a non flat label panel area is shown to be useful with the present invention.

FIGS. 5 through 9 illustrate a freestanding container 70 having a neck portion 72 including an upper finish portion 74 terminating at its uppermost end in an opening 76 which allows communication between the hollow interior of the container and the exterior. A suitable closure 77 is attached to the finish 74 to seal the container 70. In the embodiment of the invention shown in FIG. 5 a pump spray closure apparatus is illustrated which is suitable for clothing prewash and similar uses. The neck 72 downwardly depends from the finish 74 and bifurcates near the label area into a pair of downwardly depending spaced apart sidewalls 78 and 80. The sidewalls 78 and 80 merge at the lowermost portion of the container 70 into a bottom panel 82. A pair of spaced apart label areas 84 and 86 are connected to a pair of upstanding rim portions 88 and 90 by a pair of hinge portions 92 and 94.

The flexible hinge portions 92 and 94 extend about the entire margin of the label panels 84 and 86, respectively, and join the curved label panels 84 and 86 to the upstanding rims 88 and 90, respectively. The label panels 84 and 86 are both transversely convex. The vertical portions of the label panels 84 and 86 are composed of a continuous series of straight lines which are angled inwardly form the bottom of the container toward the top, such that the entire label panel is transversely convexed and tilts inwardly of the container from bottom to top. This compound geometry of transverse convex curvature and vertical uncurved design is necessitated by the fact that the central portions of the label panels 84 and 86 bear product identifying labels of the container 70. The vertical dimension of the label panels 84 and 86 cannot be curved, since a compound curve may not be fitted with a two dimensional label. A label on a compound curve surface will crease or spontaneously detach after adhesion to the container label surface. Such creasing or detachment is aesthetically unfavorable and is avoided by transverse convex curvature of the label panels 84 and 86 while maintaining a vertically straight geometry.

Figure 6:
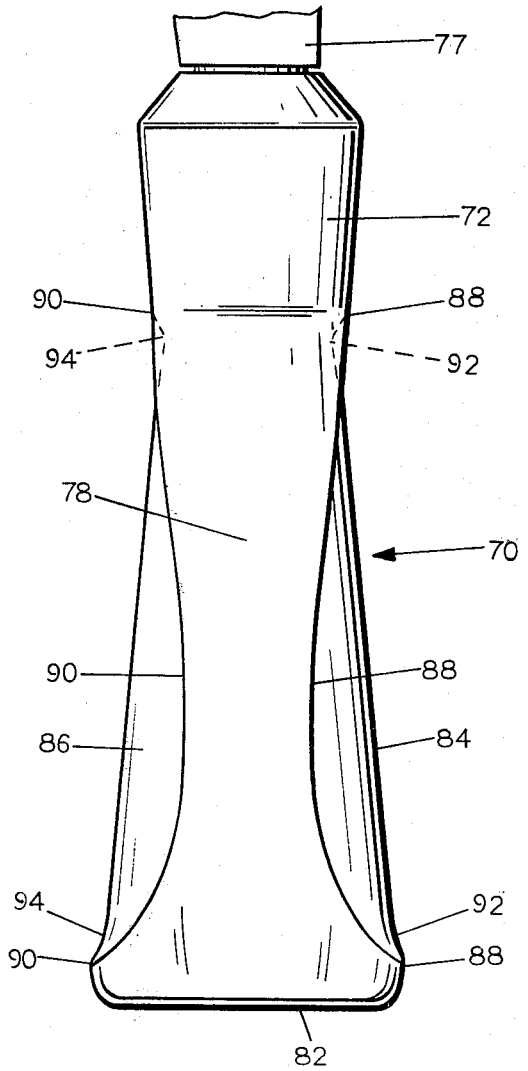
FIG. 6 is a side elevational view of a container illustrated in FIG. 5.

FIG. 6 is a side elevational view of the container 70 of the present invention. FIG. 6 illustrates more clearly the label areas 84 and 86 and the associated rim portion 88 and 90. Shown in phantom line section are the uppermost portions of the hinges 92 and 94. Note that the uppermost and lowermost portion of the upraised rims 88 and 90 in the embodiment of the invention shown in FIGS. 5 through 9, extend beyond the outermost surface of the label panels 84 and 86. The lateral portions of the upraised rims 88 and 90 are disposed below the outermost surface of the label panels 84 and 86.

As the transversely convex, vertically straight label panels 84 and 86 are drawn inwardly of the container 70 due to partial evacuation thereof, the stresses induced by the flattening of the curved label panels 84 and 86 absorbed by the hinge areas 92 and 94.

Accordingly, the stresses due to the flexion of the label panel areas 84 and 86 are not effectively transmitted to the rim portions 88 and 90, the sidewall portion 78 and 80, the neck 72 or bottom portion 82.

Figure 7:
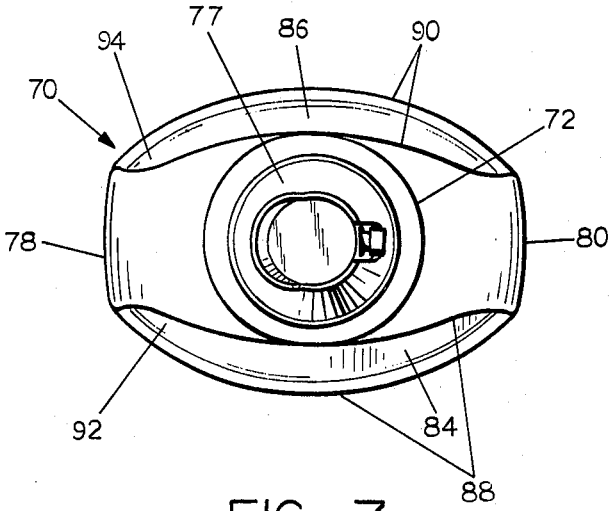
FIG. 7 is a top plan view of a container illustrated in FIG. 5.

FIG. 7 illustrates a top plan view of the present invention as embodied having curved label panel areas. FIG. 7 clearly illustrates the outward taper of the label panel areas 84 and 86 from top to bottom and the transversely curved feature of the label panels 84 and 86.

Figure 9:
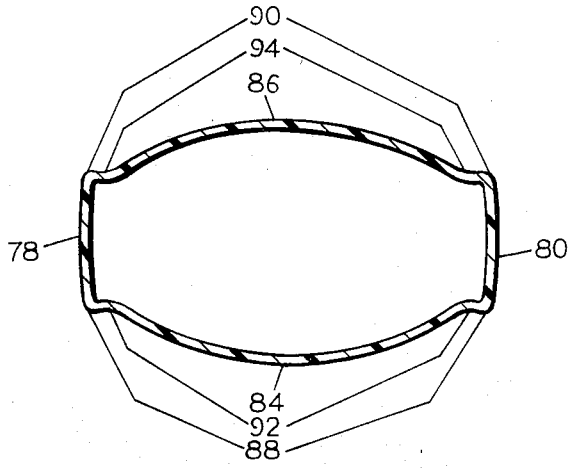
FIG. 9 is a cross sectional view of the container of FIG. 5 along the lines 9—9.
Figure 8:
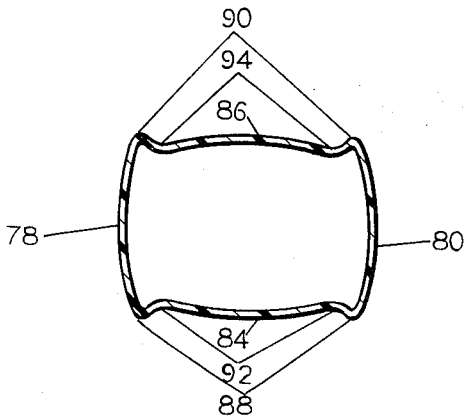
FIG. 8 is a cross sectional view of the container of FIG. 5 along the lines 8—8.

FIGS. 8 and 9 most clearly show the gradually curving structure of the hinge portions 92 and 94 as they blend the label panel areas 84 and 86 into the upstanding rims 88 and 90.

In use, a container according to the present invention is filled with a product containing a volatile organic component or one which absorbs headspace gases and sealed by appropriate closure means. During the shelf life of the container a portion of the headspace gas is absorbed by the container contents or a volatile portion of the product contained evaporates across the container wall. In either event, a partial vacuum is created on the interior of the sealed container. The partial vacuum is created slowly over a long period of time. As such a partial vacuum is created there is an ever increasing force, due to the difference between internal and external pressure, forcing inward deformation of the label panel areas.

In ordinary containers, as the inward deformation of the label panel occurs, stress crazing or stress cracking in extreme cases occurs in the sidewall, neck and bottom portions of the container. Also, when such label area deformation occurs, label structures may detach or become creased beyond acceptable limits. The stress crazing or cracking contributes therefore to a diminuation in the product identifying function of the container. As importantly, the stresses cause structural defects in the container which diminish the structural integrity of the container.

The present invention militates against such structural degradation due to label area uncontrolled collapse. As the partial vacuum is formed on the interior of the container, the label panel areas collapse slowly inwardly of the container. As they collapse inwardly the upstanding rim, which is more rigid than the flexible hinge portions, forces the stresses to be concentrated in the flexible hinge areas. The concentration of the collapsing forces due to the inward movement of the label panel in the hinge area isolates such forces from the neck, bottom and sidewalls of the container. This isolation of the neck, bottom and sidewalls protects those areas from stresses due to label panel collapse. By so protecting these areas, stresses which could cause stress cracking or crazing there at are substantially lowered in such areas.

I claim:

1. A unitary container made from an organic thermoplastic material comprising:

an upstanding neck portion terminating in a finish portion defining an opening into said container;

a pair of spaced apart sidewall panels connected to and depending downwardly from said neck portion;

a bottom portion connected to said spaced apart sidewall panels and providing a base for said container; and a pair of spaced apart label panels connected to said neck portion, said sidewall panels and said bottom portion to thereby define an enclosed volumn for said container, each of said label panels including a centrally located collapsible label area, a peripherally located, upstanding rim portion and a flexible hinge portion inward of and adjacent to said upstanding rim portion and extending around the entire intersection of said upstanding rim portion and said collapsible label area.

2. The invention defined in claim 1 wherein said label panel is generally rectangular.

3. The invention defined in claim 2 wherein said generally rectangular label panel is substantially flat.

4. The invention defined in claim 1 wherein said label panel is generally elliptical with its major axis parallel to the major axis of the container.

5. The invention defined in claim 4 wherein said generally elliptical label panel is laterally convex and longitudinally straight.

6. The invention defined in claim 5 wherein said lateral convexity has a maximum at the center of said label panel and a minimum at its junction with said flexible hinge portion.

7. The invention defined in claim 6 wherein said rim portion includes an uppermost portion adjacent said neck portion and lowermost portion adjacent said bottom portion and said uppermost and lowermost portions are disposed outwardly of said maximum curvature of said label panel.

8. A unitary container made from an organic thermoplastic material comprising:

an upstanding neck portion terminating in a finish portion defining an opening into said container;

a pair of spaced apart sidewall panels connected to and depending downwardly from said neck portion;

a bottom portion connected to said spaced apart sidewall panels and providing a base for said container; and a pair of spaced apart label panels connected to said neck portion, said sidewall panels and said bottom portion to thereby define an enclosed volumn for said container each of said label panels including a centrally located collapsible label area, a pair of spaced apart upstanding rim portions and a flexible hinge portion blending each of said upstanding rim portions into said centrally located collapsible label area.

9. The invention defined in claim 8 wherein said label panel is generally rectangular.

10. The invention defined in claim 9 wherein said generally rectangular label panel is generally flat.

* * * * *